US006907821B2

(12) United States Patent
Strasser

(10) Patent No.: US 6,907,821 B2
(45) Date of Patent: Jun. 21, 2005

(54) ROTARY PRESS TO LAY DOWN PATTERNS ON A SUPPORT STRIP

(75) Inventor: Georg Strasser, Kradolf (CH)

(73) Assignee: Bobst SA (CH)

( * ) Notice: Subject to any disclaimer, the term of this patent is extended or adjusted under 35 U.S.C. 154(b) by 0 days.

(21) Appl. No.: 10/643,615

(22) Filed: Aug. 19, 2003

(65) Prior Publication Data

US 2004/0035305 A1 Feb. 26, 2004

(30) Foreign Application Priority Data

Aug. 19, 2002 (CH) ..... 2002 1419/02

(51) Int. Cl.[7] ..... B41F 1/07; B41F 19/02; B41F 19/06; B41F 5/00

(52) U.S. Cl. ..... 101/22; 101/23; 101/182; 101/185; 101/247; 101/218

(58) Field of Search ..... 101/22, 23, 182, 101/185, 247, 139–154, 218, 284, 285

(56) References Cited

U.S. PATENT DOCUMENTS 3,391,638 A * 7/1968 Ebneter ..... 101/407.1
3,655,312 A * 4/1972 Erb et al. ..... 425/115
5,588,362 A * 12/1996 Sugiyama et al. ..... 101/218
5,921,175 A * 7/1999 Bates ..... 101/32
6,062,134 A * 5/2000 Eitel et al. ..... 101/28

FOREIGN PATENT DOCUMENTS

| | | |
|---|---|---|
| EP | 0 469 433 | 2/1992 |
| FR | 1 367 861 | 7/1964 |

* cited by examiner

*Primary Examiner*—Andrew H. Hirshfeld
*Assistant Examiner*—Marissa Ferguson
(74) *Attorney, Agent, or Firm*—Ostrolenk, Faber, Gerb & Soffen, LLP

(57) ABSTRACT

A rotary press to lay patterns of a material on a strip material comprises a working cylinder bearing embossing plates of the patterns of the aforesaid material to be laid and an opposed anvil cylinder. The working cylinder is rotated. A heater for the working cylinder. A device to exert a defined prestress between the working cylinder and the anvil cylinder. Ball-bearings between the anvil cylinder and its shaft. A device adjusts the space between the working cylinder and the anvil cylinder, independent of the device to exert the defined prestress.

17 Claims, 5 Drawing Sheets

ROTARY PRESS TO LAY DOWN PATTERNS ON A SUPPORT STRIP

BACKGROUND OF THE INVENTION

The present invention relates to a rotary press to lay patterns of a material on a strip material, including a working cylinder carrying embossing plates of the patterns on the aforesaid material to be laid and an anvil cylinder, means to rotate the working cylinder, means to heat and control the temperature of this working cylinder, means to exert a defined prestress between the working cylinder and the anvil cylinder and free bearing means between the anvil cylinder and its pivoting shaft The advantage of this type of press in contrast with flat stamping lays in the ability to work constantly with a perceptible faster speed than during the flat stamping process. The gas resulting from the vaporization of the wax that is located between the polyester support strip and the metal embossing plate of the strip material is discharged in an easier way and the consumption of strip material to be laid can be perceptibly reduced. This material, generally made of a laminated compound of four layers, a polyester support strip, a layer of wax, a metallic embossing plate and a layer of glue, is expensive.

To allow a reduction of the consumption of strip material to be laid in an optimal way, it is not only necessary to use a rotary press but the strip material should not cross the rotary press according to the standard path, but in an almost linear path. Indeed, during the standard path, the strip material to be laid and the support strip on which the pattern of the material has been laid, stay one touching the other and are pressed against the anvil cylinder upon a given angle of this anvil cylinder after being passed through the cylinders of the rotary press to increase the time of contact and facilitate the fixing of the pattern laid on the support strip. This standard process of passage perceptibly limits the saving possibilities of the strip material to be laid because the support strip and the strip material have to move simultaneously.

To allow an optimal saving of the consumption of strip material, one should be able to stop, or even withdraw a certain length of the strip material between two pattern deposits on the support strip. This is only possible if the strip material to be laid and the support strip are almost only in contact over a line corresponding to the respective contact lines between the two cylinders of the rotary press, or at the very least over a small enough lengthwise distance of the strip support to allow a related displacement as soon as they are not pinched anymore between the cylinders of the press, in other words between two successive transfers of the patterns on the support strip. This is only possible if the strip material to be laid has an almost linear path.

Taking into consideration the constraints and in particular the very short time of contact between the strip material to be laid and the support strip, the average temperature of the working cylinder of the rotary press has to be higher and the allowable temperature deviations are smaller than in flat stamping and in a rotary press with standard path, mentioned above.

In order to satisfy this very low level of tolerance, it is not only necessary to precisely control temperatures, but it is also indispensable that the exerted pressure between the press cylinders and the space between these cylinders that allows the simultaneous passage of the support strip, the strip material with the pattern to be laid and the embossing plates, be precisely adjusted, avoiding that the adjustment of one of these two parameters exercise an influence on the other. It is also important that the space between the cylinders crossed by the support strip, the strip material and the embossing plate be kept constant and not vary when the temperature of the working cylinder increases.

SUMMARY OF THE INVENTION

The aim of the present invention is to provide a solution allowing contributing, at least to a certain extent, to an optimal utilization of the strip material to be laid on a support strip while keeping the precision in the adjustment of the working parameters of the press.

To this aim, the present invention refers to a rotary press for laying patterns of a material on support material. The press includes a rotable working cylinder which has a first axis and has a periphery. A drive rotates the working cylinder around its first axis. There are embossing plates that hold the patterns of the material that is to be laid on the support and those plates are held on the working cylinder. The working cylinder is heated in a controlled manner.

An anvil cylinder also has a periphery and is placed such that the peripheries of the cylinders are in opposition to each other but spaced apart. The anvil cylinder has its own second axis. A shaft extends through the anvil cylinder and there are bearings between the anvil cylinder and its shaft.

There is a prestress application assembly that is operable to exert a defined prestress between the working cylinder and the anvil cylinder to effect the laying of the patterns on the support strip. However, the peripheries are spaced apart and there is a space adjustment device connected with at least one of the cylinders to adjust the space between the working cylinder and the anvil cylinder wherein the space adjustment device is independent from the prestress application assembly which maintains the necessary prestress. A winch driven rocking member may operate for causing and adjusting the prestress. Eccentrics at one or both ends of the anvil cylinder may be rotated in angular position to adjust the space between the cylinders.

In this rotary press, the adjustment of the prestress exerted between the press cylinders, to carry out the deposit of the patterns on the support strip from the material hold on the strip material, is completely independent from the adjustment of the space between the cylinders, so that the two parameters can be adjusted with precision. The support strip should almost follow a linear path through the cylinders, limiting to the minimum the contact time between the two bands during the deposit process of the patterns. As explained before, the linear passage, or almost linear passage, of the strip material to be laid through the press cylinders allows speed modulation of the support strip between the deposit of two successive patterns and thus an optimal use of the material strip.

Other characteristics and advantages of the present invention will be described along the following description that will be achieved in relation with the enclosed drawing that illustrates, schematically and as an example, one type of execution of the invented rotary press.

Other features and advantages of the present invention will become apparent from the following description of the invention which refers to the accompanying drawings.

DESCRIPTION OF PREFERRED EMBODIMENTS

Figure 1:
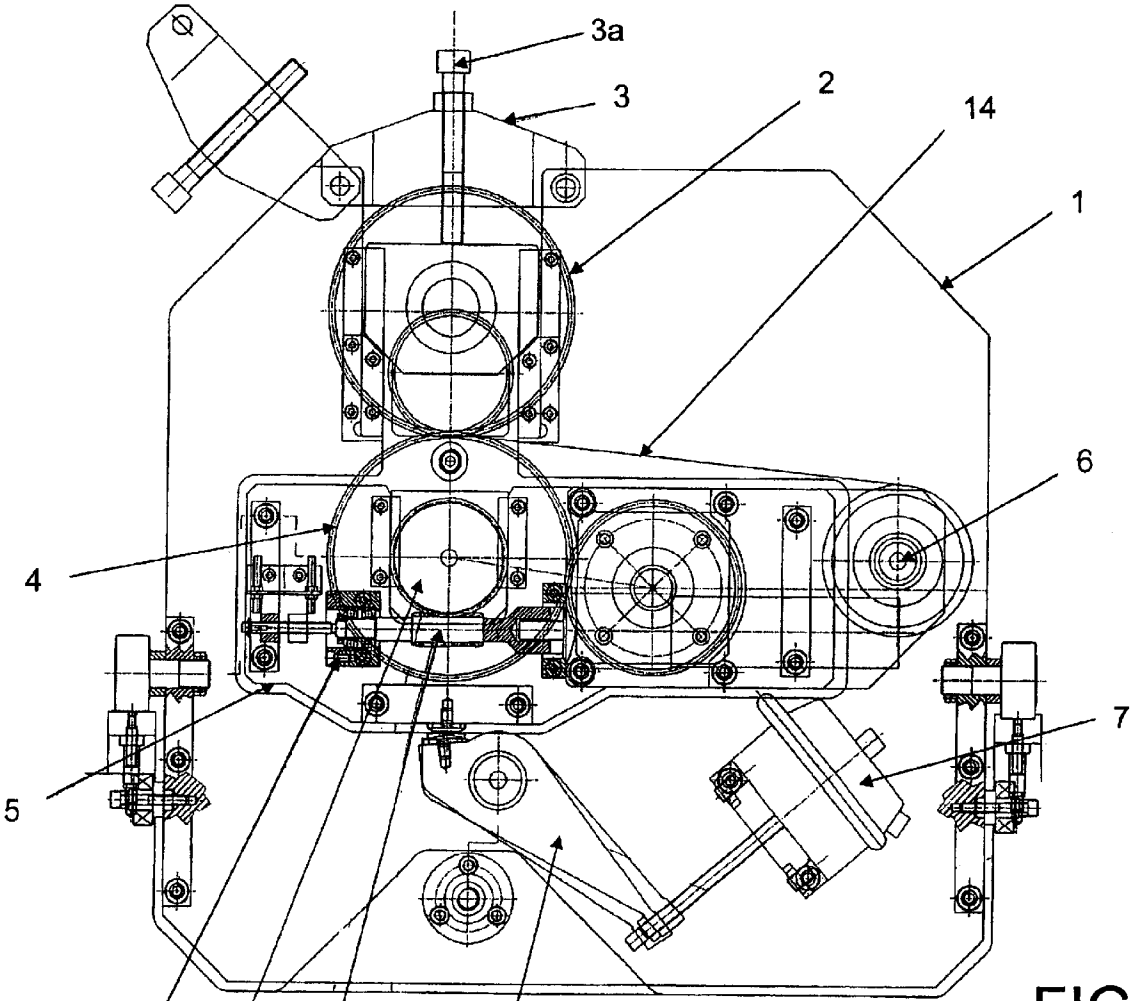
FIG. 1 is an elevation view of a rotary press.

The rotary press according to the invention comprises a frame 1 on which is mounted a working cylinder 2, with respective ends which are fixed on the frame 1 by fixing members 3. Each member 3 is equipped with a tightening screw 3*a*. An anvil cylinder 4, parallel to the working cylinder 2, freely pivots on a rocking member 5 which is mounted in a pivot on frame 1 and pivots around an axis 6 which is parallel to the axes of cylinders 2 and 4. A winch 7 is used to press the anvil cylinder 4 against the working cylinder 2, with a definite prestress force, through the medium of a lever 7*a* which acts on rocking member 5 and is able to gear down the pressure exerted by winch 7.

Figure 2:
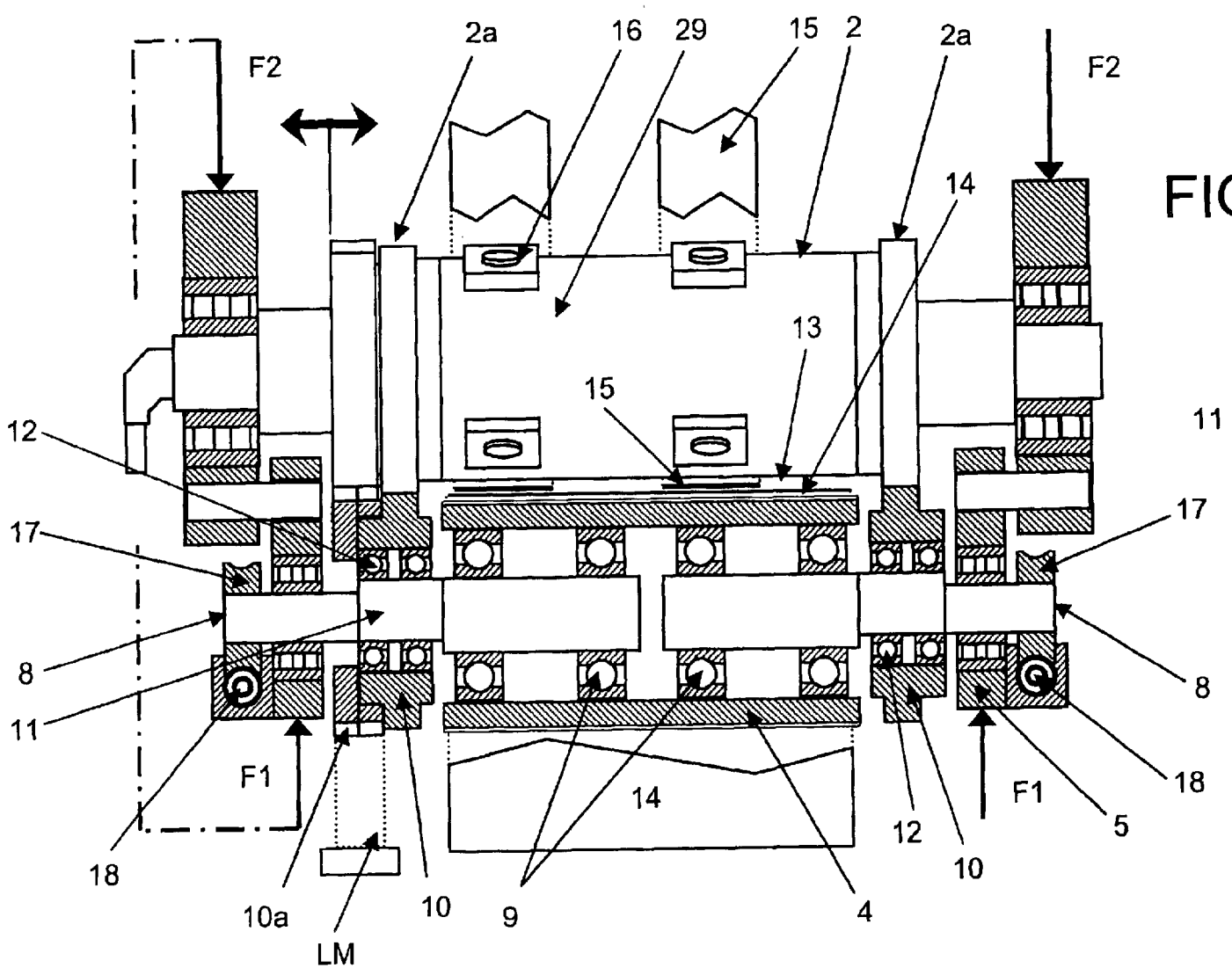
FIG. 2 is a schematic view according to line A—A of FIG. 1.

FIG. 2 shows how the pressure of winch 7 is transmitted from working cylinder 2 to anvil cylinder 4. This pressure is symbolized by two arrows F1, F2. Anvil cylinder 4 is mounted in a pivot around two coaxial half-shafts 8 through ball-bearings 9. Two cylindrical rings 10 are mounted on two eccentric parts 11 of the respective half-shafts 8 through ball-bearings 12. The cylindrical rings 10 are in running touch with two cylindrical surfaces 2*a* fitted to the working cylinder 2.

These cylindrical rings 10 and cylindrical surfaces 2*a* constitute the contact surfaces between working cylinder 2 and anvil cylinder 4. They allow the transmission of the prestress exerted by winch 7 while saving a space 13 between working cylinder 2 and anvil cylinder 4 for the passage of a support strip 14 and one or several strip material 15 with the patterns to be laid on support strip 14. This space 13 is defined such that the exerted prestress and the temperature of working cylinder 2 allow the heating transmission of the patterns of the strip material 15 on the support strip 14 during the passage of the embossing plates 16 within the space 13 between the two cylinders 2, 4.

One of the cylindrical rings 10 is rigidly locked with a toothed wheel 10*a* which gears with a toothed wheel 2*b* rigidly locked with the working cylinder 2. Toothed wheel 10*a* is coupled to a driving motor (not represented) through a gear LM.

The external ends of each half-shaft 8 are rigidly locked with a toothed wheel 17 coupled with a worm 18 rigidly locked with a bevel pinion 19, linked with a handle (not represented) allowing an adjustment of the space 13. It is also possible to influence space 13 on only one side of cylinder 2 and create a slightly gradual change of space 13 through the width of support strip 14. This system can also be replaced by two motors, each of them acting on one of worms 18. The half-shaft 8 rotation of a defined angle makes the eccentric parts 11 turn around the coaxial half-shafts 8 axis, thus modifying space 13 between working cylinder 2 and anvil cylinder 4, without modifying the prestress value exerted on cylinders 2 and 4 through the cylindrical surfaces of contact 2*a* and 10.

To realize the deposit and fixing of the patterns of the strip material 15, cut and heated by embossing plates 16 of working cylinder 2 on the support strip 14, the external layer of the material band 15, adjacent to the support band 14 on which the patterns are laid, is made up of thermo hardening glue. This is the reason why working cylinder 2 requires means of heating.

Figure 3:
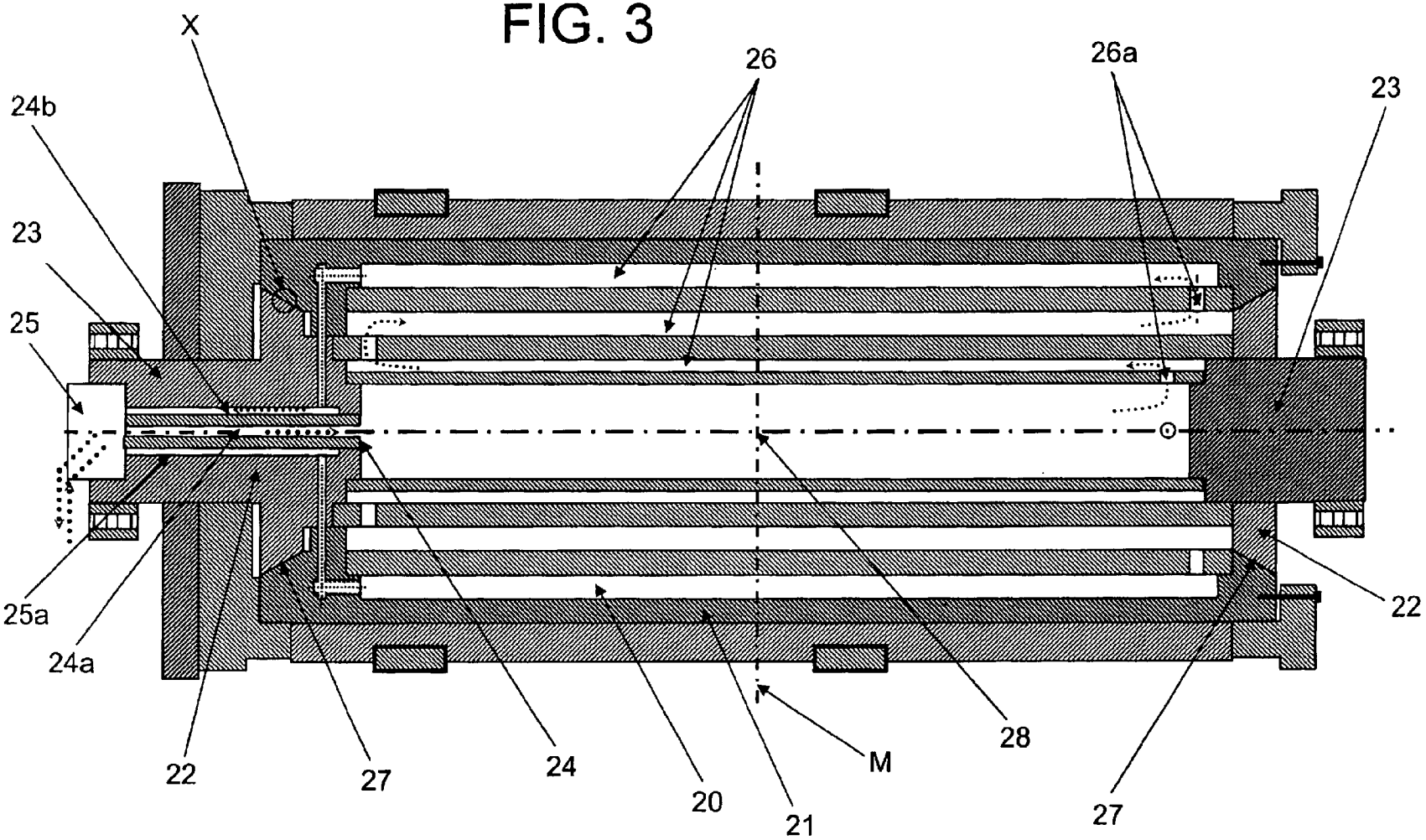
FIG. 3 is an enlarged partial cutting view of the working cylinder that is represented uncut on FIG. 2.

FIG. 3 shows the inner part of working cylinder 2 that comprises a heating housing 20 made up of a tubular part 21 in thermal contact with working cylinder 2. The two extremities of this heating housing 20 are closed by flanges 22, which have a center that is rigidly locked with a pivoting cylinders 23 coaxial to the axis of working cylinder 2. One of these pivoting cylinders (the one on the left of FIG. 3) is crossed by a tube 24 divided in two concentric channels 24*a*, 24*b* by a tubular wall 25*a* of a turning connection 25, aimed to link the heating housing 20 to a heating oil circuit (not represented). The inner part of the heating housing 20 is divided in several parts by concentric tubular walls 26, equipped with perforations 26*a* in order to create a flow in a back and forth motion of the heating medium between the entry channel 24*a* and the outgoing channel 24*b*.

For mechanical and thermal transfer reasons, the tubular part 21 of the heating housing 20 and the closing flanges 22 of these housings' extremities are made up of various metals such as steel for the external parts such as the external cylindrical parts of working cylinder 2, and closing flanges 22 and aluminum for the heating housing 20. In order to avoid the creation of space between the surfaces of contact 21*a*, 22*a* of these two components 21, 22 that would modify the adjustment of space 13 between cylinders 2 and 4, these surfaces 21*a*, 22*a* are cone-shaped with a half angle $\alpha$ at the top of these cone-shaped surfaces of contact 21*a*, 22*a* corresponding to the hypotenuse of a right-angle triangle, and the other sides of the triangle correspond to the longitudinal thermal dilatation, or expansion or contraction, of a given point of one of the aforesaid surfaces of contact 21*a*, 22*a* in relation to the median axis M of the aforesaid heating housing 20 at a given temperature, respectively at the radial dilatation of this identical point at the identical temperature, so that surfaces of contact 21*a*, 22*a* remain joint under any temperature within the cylindrical heating housing 20. By making line A–C of FIG. 4 pass by center 28 of the working cylinder 2, the angle $\alpha$ is determined for each specific case.

Figure 4:
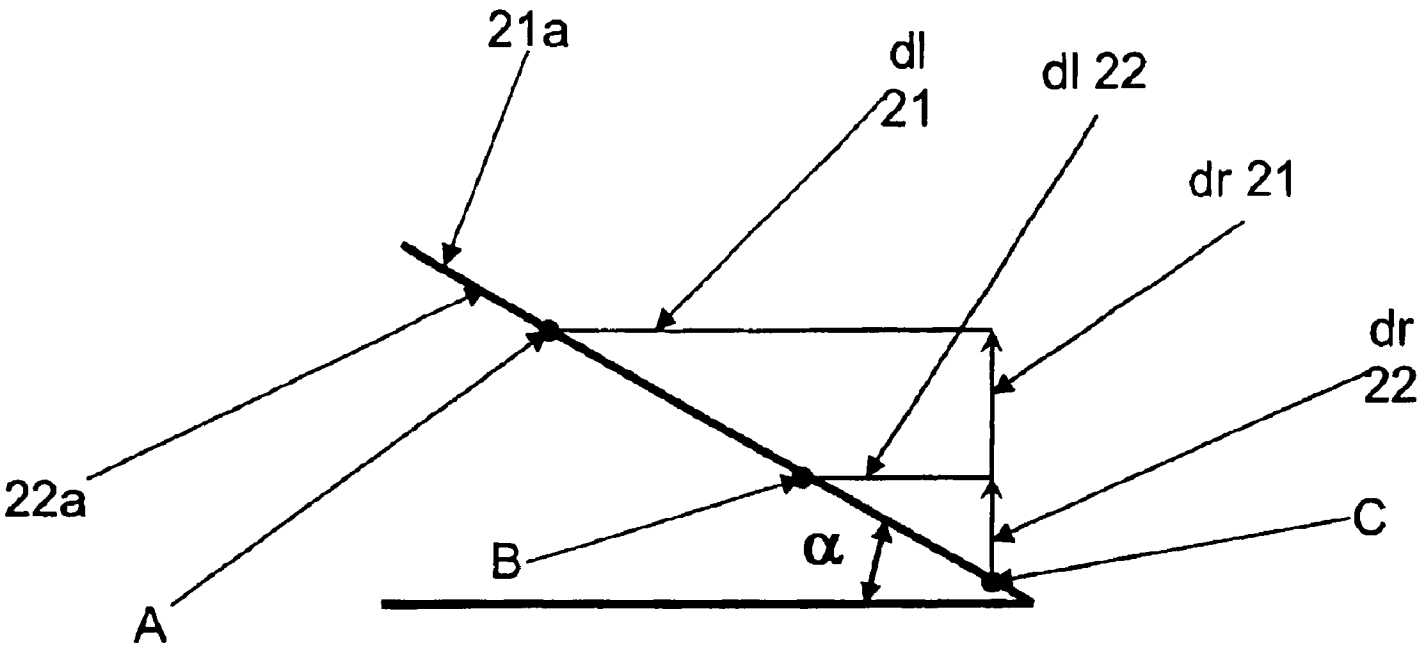
FIG. 4 is a partial view very much enlarged of "X" of FIG. 3.

As a matter of fact, if we examine, in reference with FIG. 4, what happens in case of a rise of temperature $\Delta T$, studying two adjacent points, one located on the cone-shaped surface 22*a* of flange 22 and the other on the cone-shaped surface 21*a* of the tubular part 21 that are, at temperature T, merged into one another in point C on the explanatory diagram of FIG. 4, we observe that at temperature $T+\Delta T$, the point located on the cone-shaped surface 22*a* of flange 22 has moved to B, which is the resultant of the radial dilatation $dr_{22}$ of this point and of its longitudinal dilatation $dl_{22}$ in relation to the median axis M of the heating housing 20.

In fact, this resultant is the hypotenuse of a right-angle triangle, which sides $dr_{22}$ and $dl_{22}$ are proportional to the radial dilatations, respectively longitudinal, which depend on the respective longitudinal radial dimensions of a given point. These radial and longitudinal dimensions vary according to the dilatation factor of the material, but their ratio and thus the angle of the hypotenuse, is constant. That is how the same adjacent point taken on the cone-shaped surface 21*a* of the tubular part 21 of the heating housing 20, at the same point C of FIG. 4, at temperature T, is located at point A at temperature $T+\Delta T$ and that this point A is located on the hypotenuse of a right-angle triangle, which sides correspond to the radial dilatation $dr_{21}$, respectively to the longitudinal dilatation $dl_{21}$ of the tubular part 21 at this point C. Now the ratio between these sides $dr_{21}$ and $dl_{21}$ remains similar as between sides $dr_{22}$ and $dl_{22}$ corresponding to the dilatation on the cone-shaped surface 22*a* of the closing flange 22, so that the angle $\alpha$ of the hypotenuse is the same. Therefore, with these cone-shaped surfaces of contact 21*a*, 22*a*, there is no space created in consequence of temperature variations, even if the dilatation factor varies for the two materials and if the external surface of the working cylinder 2 remains unmoved in relation to its rotary axis, due to the fact that there is no space created between these cone-shaped surfaces 21*a*, 22*a*, so that space 13 between this working cylinder 2 and anvil-cylinder 4 remains constant. Under these conditions, even if this space 13 has been adjusted when the press is cold, it remains the same when working cylinder 2 is warm.

Preferably, two seal gaskets O-ring 27 are set near to the two edges of the cone-shaped surface of contact 22*a*, of the closing flanges 22, with the cone-shaped adjacent surface 21*a* of the tubular part 21 of the heating housing 20.

One important aspect is to create a correct transfer of heat (thermal power) through embossing plates 16 of cylinder 2. We observe the following facts: The only way to influence the energy transfer through the embossing plate by millisecond is to increase the temperature and/or the flow rate delivered by the heating means. According to the pattern of the embossing plate, it is possible that differences in temperature are desired. Then, the representative temperature of 220° C. is going to induce a significant radiation at total loss, to heat the surroundings; this is thus an undesirable phenomenon.

Figure 5:
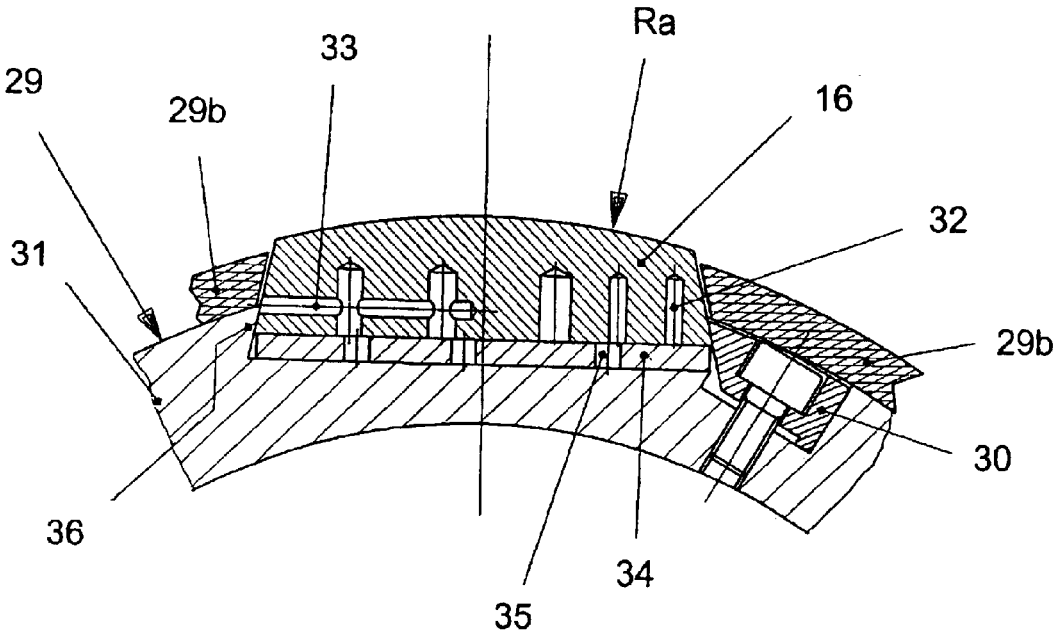
FIG. 5 illustrates a first example of the fixing of an embossing plate on a working cylinder.

In order to improve the situation, various measures are suggested to be adopted. Faces 29, which are not covered by the embossing plates of cylinder 2, can be covered with an isolating layer, helping the passage of the available heat through the embossing plates 16 (FIG. 5, 29*b*). To manage a selective passage of the heat through each embossing plate 16, all or some of the following measures are going to be used (i.e. FIG. 5): an embossing plate 16 can be inserted and fixed with adequate means 30 in a supporting tube that can be slipped over working cylinder 2. Pieces 31 and 2 can also be the same. Embossing plate 16 can be equipped with recessed holes 32, of variable dimensions and distribution, linked or not by drillings 33 facilitating air release during changes of temperature. This is going to create air pockets and efficient restrictions to heat transmission. The embossing plates can be put on blocks 34 that will accessorily allow the adjustment of their active radius Ra within small values. These blocks 34 can be equipped or not with holes of variable dimensions and distribution. This can also be recessed holes. Profile of holes 32, 35 can be in line with each other or not. Block 35 can also be made of isolating substance, resistant to heat. The utilization of compound materials (pressed out of powder) can also be considered. In brief, the energy transfer through one or several embossing plates can be limited with regards to the others.

Embossing plates 16 are often made of brass and tube 31 in steel and this can be a source of problem. The fastening has to be able to hold differential dilatations.

FIG. 5 also shows a suggestion of disposition for this fastening. A block 30, in isolating substance or not, allows to wedge embossing plate 16 positively against the left abutment 36, ensuring its exact repositioning if retouched. Thermal differential dilatations between parts 31 and 16 are allowed by the controlled elasticity of piece 30.

Figure 6:
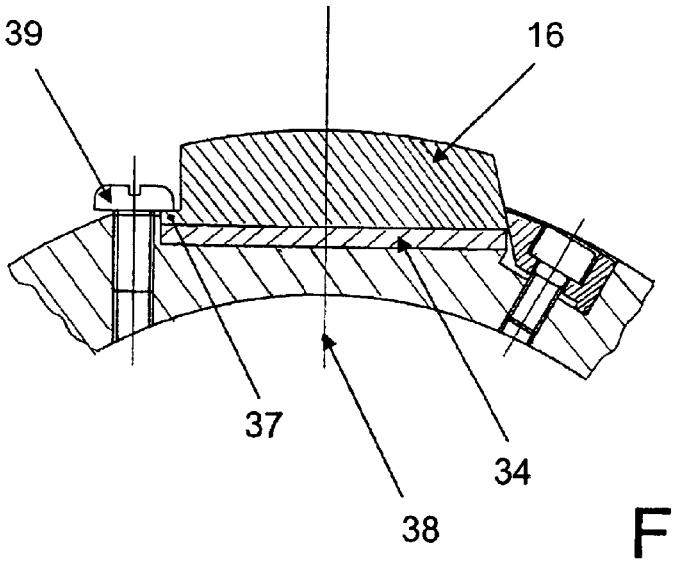
FIG. 6 represents a second example of the fixing of an embossing plate on a working cylinder.

FIG. 6 shows that it is possible to allow alternative fastenings where a change in the depth of block 34 does not provoke any angular shifting of embossing plate 16. This is the result of an adequate orientation of reference face 37. This orientation, parallel to central line 38 of the embossing plate, nevertheless involves a complementary fastening, for example screw 39.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A rotary press for laying patterns of a material on a support strip, the press comprising:

a rotatable working cylinder having a first axis and a first periphery;

a drive for rotating the working cylinder around the first axis;

a temperature control device for heating and controlling a temperature of the working cylinder;

embossing plates holding the patterns of the material to be laid on the support strip, the embossing plates being held on the first periphery of the working cylinder;

a rotatable anvil cylinder having a second axis and a second periphery, the anvil cylinder being positioned with respect to the working cylinder such that the first periphery of the working cylinder is spaced apart from and in opposition to the second periphery of the anvil cylinder;

a shalt through the anvil cylinder along the second axis;

bearings between the anvil cylinder and the shaft for supporting the anvil cylinder for rotation on the shaft;

a prestress application assembly operable to exert a defined prestress between the working cylinder and the anvil cylinder; and a space adjustment device connected to at least one of the working and anvil cylinders to adjust the space between the working cylinder and the anvil cylinder, the space adjustment device being independent from the prestress application assembly, wherein the space adjustment device comprises:

at least one first cylindrical part coupled to the working cylinder;

at least one second cylindrical part mounted on the shaft through the anvil cylinder, and in contact with the first cylindrical part, the second cylindrical part being independently movable with respect to the anvil cylinder, the shaft through the anvil cylinder having at least one pivot portion respectively assigned to the second cylindrical part on which the second cylindrical part is defined, and the pivot portion is eccentric with respect to the second axis of the anvil cylinder; and an angle adjustment device for selectively adjusting an angular position of the eccentric pivot portion of the shaft through the anvil cylinder for adjusting the space between the first and second peripheries of the working cylinder and the anvil cylinder.

2. The press of claim 1, wherein the at least one first cylindrical part includes two first cylindrical parts respectively at opposite ends of the working cylinder, the at least one second cylindrical part includes two second cylindrical parts respectively at opposite ends of the anvil cylinder and rotatable independently of the anvil cylinder, the at least one pivot portion includes two pivot portions respectively assigned to the two second cylindrical parts and located at the opposite ends of the anvil cylinder, and each of the two eccentric pivot portions is adjustable in angular position with respect to the other eccentric pivot portion.

3. A rotary press for laying patterns of a material on a support strip, the press comprising:

a rotatable working cylinder having a first axis and an external tubular wall defining a first periphery;

a drive for rotating the working cylinder around the first axis;

a temperature control device for heating and controlling a temperature of the working cylinder, the temperature control device including a cylindrical heating housing thermally coupled to the external tubular wall of the working cylinder;

embossing plates holding the patterns of the material to be laid on the support strip, the embossing plates being held on the first periphery of the working cylinder;

a rotatable anvil cylinder having a second axis and a second periphery, the anvil cylinder being positioned with respect to the working cylinder such that the first periphery of the working cylinder is spaced apart from and in opposition to the second periphery of the anvil cylinder;

a shaft through the anvil cylinder along the second axis;

bearings between the anvil cylinder and the shaft for supporting the anvil cylinder for rotation on the shaft;

a prestress application assembly operable to exert a defined prestress between the working cylinder and the anvil cylinder;

a space adjustment device connected to at least one of the working and anvil cylinders to adjust the space between the working cylinder and the anvil cylinder, the space adjustment device being independent from the prestress application assembly; and a plurality of concentric, radially spaced apart, tubular walls in the cylindrical heating housing for defining a central space and concentric surrounding spaces, the tubular walls having communication holes for connecting adjacent concentric surrounding spaces.

4. The press of claim 3, further comprising a frame;

wherein the working and anvil cylinders are pivotally attached to the frame along the first and second axes, respectively, and the prestress application assembly includes a rocking member pivotably attached to the frame along a third pivot axis that is parallel to the working cylinder and the anvil cylinder.

5. The press of claim 4, wherein the prestress application assembly includes a winch engaged with the rocking member for causing to the rocking member to exert the defined prestress between the working cylinder and the anvil cylinder.

6. The press of claim 5, further comprising a lever disposed between the winch and the rocking member, wherein the winch exerts force on the lever to move the rocking member to cause the rocking member to exert the defined prestress between the working cylinder and the anvil cylinder.

7. The press of claim 3, wherein the central and surrounding spaces have open ends at opposite sides of the cylindrical heating housing, the press further comprising:

a respective annular flange positioned at each opposite side of the cylindrical heating housing to close the open ends of the central and surrounding spaces;

a heating medium feed pipe and an axial exhaust pipe in communication with the central and surrounding spaces for transfer of a heating medium to and from the cylindrical heating housing.

8. The press of claim 7, wherein each of the annular flanges is cone-shaped having an outer surface that tapers in a direction toward the cylindrical heating housing, and each of the opposite sides of the cylindrical heating housing has an inner surface that also tapers in a direction toward the cylindrical heating housing, and the inner surface is shaped for receiving and contacting the outer surface of a respective annular flange at an interface therebetween.

9. The press of claim 8, wherein the outer surface of each flange and the inner surface of each side of the cylindrical heating housing are angled such that, in a longitudinal cross-section, the interface between the outer surface of the flange and the inner surface of the side of the cylindrical heating housing corresponds to a hypotenuse of a right angle triangle having two additional sides corresponding to a longitudinal thermal expansion of a selected point of one of the outer and inner surfaces in contact at the interface with respect to a median axis of the heating housing at a selected temperature, with respect to a radial expansion of the selected point at the same temperature enabling the outer and inner surfaces of contact at the interface to remain joined regardless of the temperature in the heating housing.

10. The press of claim 8, wherein the heating housing and the flanges are respectively comprised of materials having different respective heat caused expansions.

11. The press of claim 3, further comprising heat energy transfer isolating elements at selected locations between the heating housing and the embossing plates.

12. The press of claim 3, further comprising structures in the embossing plates adapted for slowing heat transfer through the embossing plates.

13. The press of claim 12, wherein the structures are spring like for compensating possible errors of concentricity of the rotatable working cylinder.

14. The press of claim 3, wherein the rotatable working cylinder includes reference faces structured to respectively receive the embossing plates, the press further comprising blocks shaped for fixing the embossing plates, each of the blocks having an inclined face toward a respective embossing plate to urge the embossing plate against the respective reference face for providing precise angular and radial positioning of the embossing plate.

15. The press of claim 14, wherein each block comprises an elastic material extending over at least a portion of the length of the block.

16. A rotary press for laying patterns of a material on a support strip, the press comprising:

a rotatable working cylinder having a first axis and an external tubular wall defining a first periphery;

a drive for rotating the working cylinder around the first axis;

a temperature control device for heating and controlling a temperature of the working cylinder, the temperature control device including a cylindrical heating housing thermally coupled to the external tubular wall of the working cylinder;

embossing plates holding the patterns of the material to be laid on the support strip, the embossing plates being held on the first periphery of the working cylinder;

blocks under the embossing plates at the working cylinder for slowing heat transfers;

a rotatable anvil cylinder having a second axis and a second periphery, the anvil cylinder being positioned with respect to the working cylinder such that the first periphery of the working cylinder is spaced apart from and in opposition to the second periphery of the anvil cylinder;

a shalt through the anvil cylinder alone the second axis;

bearings between the anvil cylinder and the shaft for supporting the anvil cylinder for rotation on the shaft;

a prestress application assembly operable to exert a defined prestress between the working cylinder and the anvil cylinder; and a space adjustment device connected to at least one of the working and anvil cylinders to adjust the space between the working cylinder and the anvil cylinder, the space adjustment device being independent from the prestress application assembly.

17. The press of claim 16, wherein the blocks are comprised of sandwich type compound material.

* * * * *